United States Patent [19]

Justus

[11] 4,086,130

[45] Apr. 25, 1978

[54] CONTROL SYSTEM AND METHOD FOR A MULTI-CHANNEL PAPER MACHINE DISTRIBUTOR

[75] Inventor: Edgar J. Justus, Beloit, Wis.

[73] Assignee: Beloit Corporation, Beloit, Wis.

[21] Appl. No.: 705,828

[22] Filed: Jul. 16, 1976

[51] Int. Cl.[2] ..... D21F 1/06; D21F 11/04

[52] U.S. Cl. ..... 162/123; 162/125; 162/198; 162/252; 162/253; 162/259; 162/263; 162/343; 162/DIG. 11

[58] Field of Search ..... 162/DIG. 11, 252, 253, 162/256, 259, 263, 343, 347, 123, 125, 198, 202

[56] References Cited

U.S. PATENT DOCUMENTS

| | | | |
|---|---|---|---|
| 2,677,991 | 5/1951 | Goumeniouk | 162/343 |
| 3,293,120 | 12/1966 | Hurman, Jr. et al. | 162/253 |
| 3,337,393 | 8/1967 | Parker | 162/252 |
| 3,598,696 | 8/1971 | Beck | 162/298 |
| 3,703,436 | 11/1972 | Rice | 162/253 |
| 3,711,688 | 1/1973 | Stout et al. | 162/259 |
| 3,779,863 | 12/1973 | Wahren | 162/253 |
| 3,886,036 | 5/1975 | Dahlin | 162/253 |
| 3,923,593 | 12/1975 | Verseput | 162/343 |
| 3,935,061 | 1/1976 | Biorstad | 162/252 |
| 4,021,295 | 5/1977 | Schmaeng | 162/125 |

*Primary Examiner*—S. Leon Bashore
*Assistant Examiner*—Steve Alvo
*Attorney, Agent, or Firm*—Hill, Gross, Simpson, Van Santen, Steadman, Chiara & Simpson

[57] ABSTRACT

At least one channel in a multi-channel paper machine distributor is maintained in flow velocity slave relation to another of the channels by monitoring the velocity with a pressure transducer of stock flow through the latter channel and by such monitoring controlling the stock velocity in the slave channel.

14 Claims, 3 Drawing Figures

LEGEND TABLE

FIC. - FLOW INDICATING CONTROLLER
FI - FLOW INDICATOR
FT - FLOW TRANSMITTER
M - MOTOR
PIC - PRESSURE INDICATING CONTROLLER
PT - PRESSURE TRANSMITTER
PI - PRESSURE INDICATOR
SP - SET POINT
ΔPT - DIFFERENTIAL PRESSURE TRANSMITTER
√ - SQUARE ROOT EXTRACTOR
—//—//— AIR
----- ELECTRIC
——— STOCK

CONTROL SYSTEM AND METHOD FOR A MULTI-CHANNEL PAPER MACHINE DISTRIBUTOR

BACKGROUND OF THE INVENTION

This invention relates to improvements in the control of multi-channel paper machine distributors for maintaining uniform stock ratio in multi-ply paper webs.

Substantial improvement in the laminar structure, speed of operation, simplification of apparatus and savings in power consumption have resulted from developments in multi-channel head boxes or distributors. Examples of such multi-channel distributors are disclosed in U.S. Pat. Nos. 3,598,696; 3,839,143 and 3,923,593, all of which are owned by the same assignee as the present application. Characteristic of such distributors is the confluence at the slice opening of the distributor of the fibrous paper stock having the desired respective characteristics from the several, generally three, channels within the distributor which converge toward the slice opening. From the slice opening the multiple stock layers pass to the former for dewatering on or between a fabric or wire belt system and from which the composite sheet passes on through the finishing rolls of the paper making machine. These three-channel distributors are especially useful in producing paper of the kind commonly referred to as linerboard comprising a relatively thick and low bursting strength largely wastepaper heavy stock inner layer between two outer layers of generally virgin pulp heavy stock applied in relatively thin layers providing desirable finish and burst strength in the finished sheet. Before start of operation the slice opening is set to establish a basic water rate according to experience or bases on a prediction for the grade and speed of paper to be run. In addition the total head setpoint, the outer liner ratio setpoints, and the three basic weight setpoints are adjusted to the desired values. The forming section of the machine is then turned on and when it has reached running speed, the "start" button for the pumps for each of the stock supplies for the respective distributor channels are actuated. Then when the sheet is established on the machine, the basic weight is checked, the basic weight of any layer is independently readjusted as required and if formation or other sheet properties require, a change in spouting velocity or water rate or consistency. Heretofore this has required individually adjusting the flow rate or consistency for each of the channels of the distributor. Close supervision has been required to avoid undesirable ratio variances in the outer layers relative to the inner layer of the web as produced with the aid of the plural channel distributor. Another problem has been to maintain the total head at the slice opening properly controlled for the desired spouting velocity properly corelated with the speed of the former of the paper making machine.

SUMMARY OF THE INVENTION

According to the present invention the total head at the slice opening is automatically regulated to maintain the desired spouting velocity optimally corelated with the speed of the former of the paper making machine, and to maintain automatically substantially accurate ratio control over the stock flowing in the outer layer stock channels of the distributor and the velocity of the stock flowing in the center layer channel of the distributor.

An important object of the present invention is to provide a new and improved system for controlling stock flow in a multi-channel paper machine distributor.

Another object of the invention is to provide a new and improved system for automatically maintaining a desired flow ratio in a multi-channel distributor by monitoring the velocity of stock flow through one of the channels.

A further object of the invention is to provide a new and improved system for automatically controlling the flow ratio of a multi-channel distributor with the former of a paper making machine.

Still another object of the invention is to provide a new and improved method of and means for monitoring the velocity of stock flow through one channel in a multi-channel distributor for controlling another channel in slave relation to the monitored channel.

According to features of the invention the velocity of the stock flowing in the outer two channels of a three channel distributor is controlled by the velocity of the stock flowing in the center channel of the distributor, thereby avoiding undesirable fluctuations in relative velocities of the stock flowing in the three channels which would result in non-uniform, weaker and generally inferior composite web product.

Another feature of the invention resides in automatically maintaining the rush/drag ratio between the distributor and the former of a paper making machine. The rush/drag ratio is the ratio of the former speed to the velocity of the stock stream discharging from the slice opening of the distributor. More particularly, the rush/drag ratio is maintained in a multi-channel distributor by monitoring the speed of the former, monitoring the stock flow velocity in one of plural channels of the distributor, corelating the stock flow velocity through said one channel with the speed of operation of the former, and automtically adjusting the flow of the stock stream in any one or more other stock channels in the distributor in slave relation to the monitored one channel.

Other objects, features and advantages of the invention will be readily apparent from the following description of a representative embodiment thereof, taken in conjunction with the accompanying drawings although variations and modifications may be effected without departing from the spirit and scope of the novel concepts embodied in the disclosure and in which:

DESCRIPTION OF THE PREFERRED EMBODIMENT

Figure 1A:
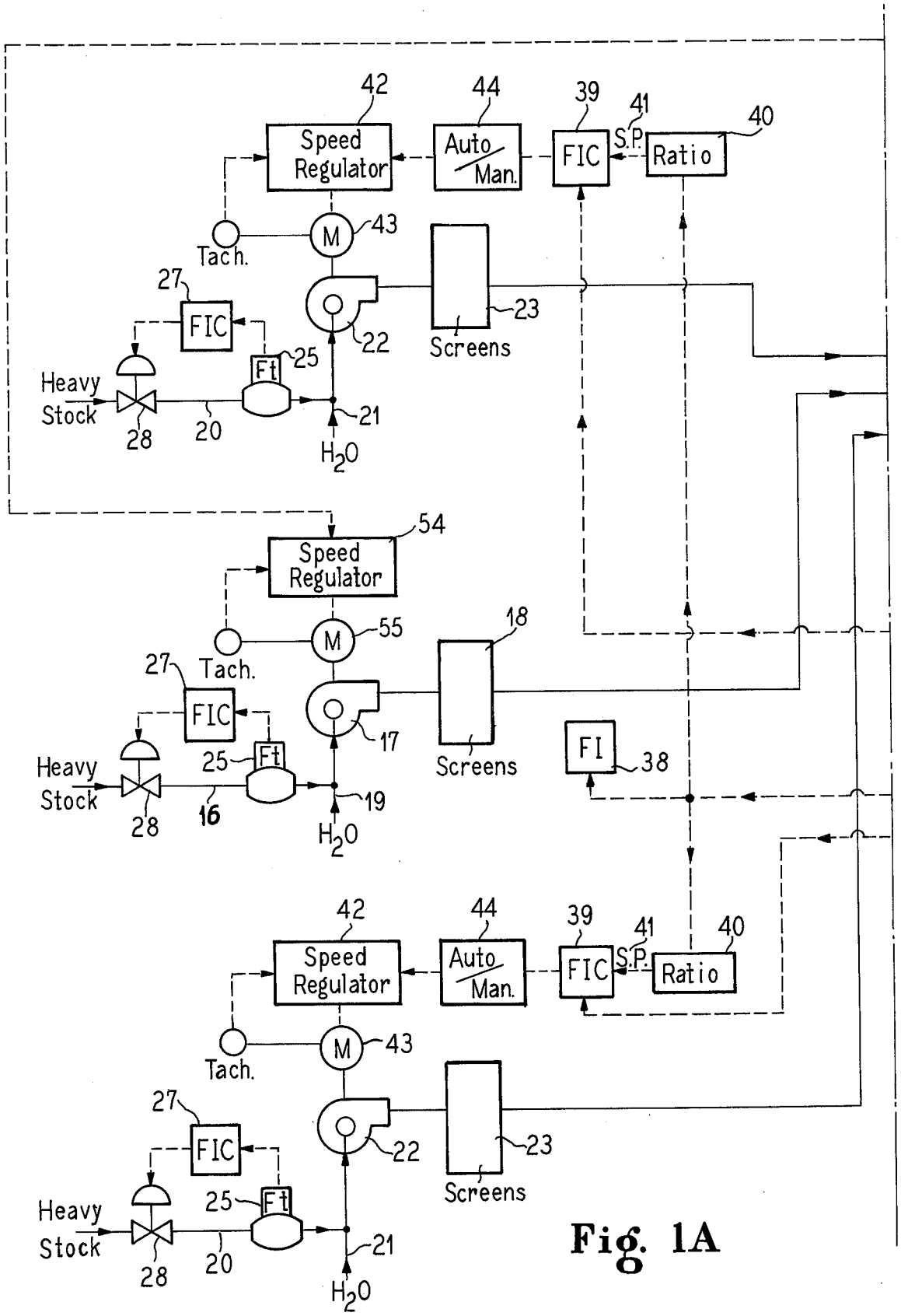
FIGS. 1A and 1B taken together provide a schematic illustration of control system for a multi-channel paper machine distributor embodying features of the invention.
Figures 1B, 2:
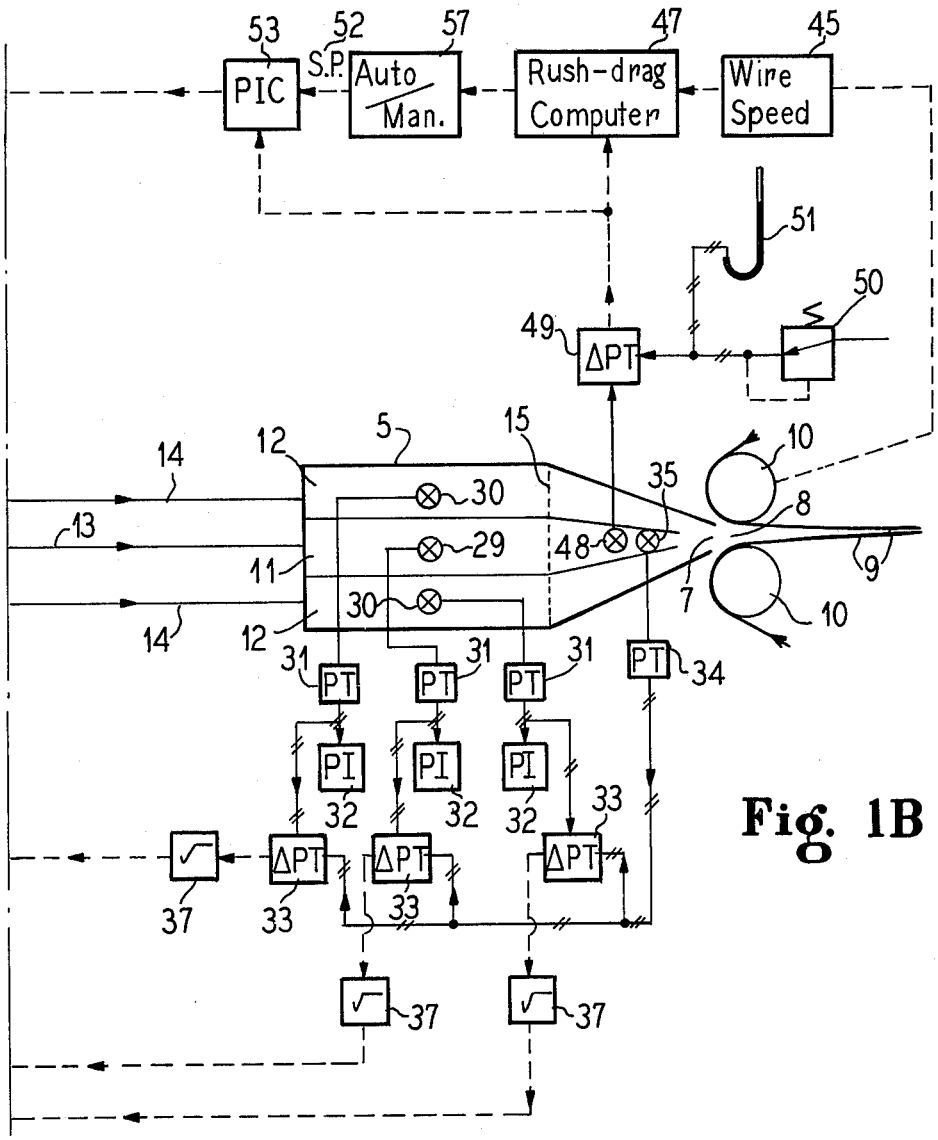
FIG. 2 is a schematic table to facilitate understanding of symbols on the composite schemtic of FIGS. 1A and 1B.

A representative head box or distributor 5 has a plurality of stock channels converging toward a slice opening 7 of a width corresponding to the width of web desired. The stock stream issuing from the slice opening 7 to start the web making process is received in throat 8 at the upstream end of the dewatering run of the paper machine former herein comprising fabric or wire belts 9 running over forming or breast rolls 10. Other details of the former, and details of the press and calendering roll system of the paper making machine need not be described because they are well known. Within the distributor 5, stock for a plurality of plies to produce a multi-ply paper web is received in and flows through a corresponding plurality of separate channels which converge toward the slice opening 7. In the illustrated example, for the production of three-ply paper product (the term paper being used herein to include paperboard, linerboard, the like) comprises a center channel 11 and two outer channels 12 one of which is at the top of the center channel 11 and the other of which is at the bottom of the center channel 11 in the drawing and substantially coextensive with the center channel. Paper stock of suitable composition is delivered by means of suitable ducts to the upstream ends of the distributor channels, comprising a duct 13 communicating with the channel 11 and respective ducts 14 communicating with the channels 12. Downstream within the channels 11 and 12 the stock passes through a perforated partition 15, downstream from which the channels converge toward the slice opening 7. It will be understood, of course, that suitable means, for which the aforementioned patents may be referred to, are provided for setting the slice opening 7 for the desired basic water rate for the grade of product desired and the speed at which the machine is to be run. It will also be understood that suitable means are provided to attain the desired total head setpoint and the top and bottom liner ratio setpoints and the three basic weight setpoints at the desired values. These are features common to earlier controls for this kind of distributor.

Means are provided for independently supplying stock in the desired concentration through the delivery duct 13 to the distributor 11 and suitable concentration stock to the outer channels 12 through their delivery ducts 14. Although the stock supplied through the center channel duct 13 will necessary generally be of a different composition from the stock delivered through the conduits 14 to the outer channels 12, the outer channel stock may be the same or different, depending upon the kind of multi-ply paper web to be produced. Therefore although the delivery duct 13 is supplied from a suitable heavy stock (stock that is in a heavier initial concentration than actually required at the slice gate) chest (not shown) which is independent from the supply source for the ducts 14, the heavy stock for the ducts 14 may be supplied from independent stock chests (not shown) or from a common stock chest, depending upon requirements. Heavy stock for the duct 13 passes by way of a conduit 16 to the intake of a suitable pump 17 such as a fan pump and then from the pump through screens 18 into the duct 13 for delivery under pump pressure into the channel 11. In order to dilute the heavy stock to the required consistency or concentration, water is supplied to the pump 17 as for example through a conduit 19 into the intake side of the pump, preferably along with the heavy stock. Similarly heavy stock is supplied to each of the ducts 14 through a respective conduit 20 and joins with suitable water supply by way of a conduit 21 to the intake side of a fan pump 22 and then from the pressure side of the pump through screens 23 into the respective conduit 14. Dilution of the heavy stock may be from on the order of 1 to 10% fibers to about 0.1 to 1.07% fibers in the stock slurry delivered from the distributor slice opening 7. Water may be supplied through the conduits 19 and 21 from separate sources or it may be derived from a common single silo for supplying white water to the system. Each of the heavy stock pipe lines or conduits 15 and 20 is independently monitored and controlled responsive to pump demand by means of a respective flow transmitter 25 which signals a flow indicating controller 27 to operate a valve 28 upstream from the flow transmitter according to the signal received from the flow indicating controller.

In order to maintain automatically a deaired stock flow ratio in the channels of the distributor 5, means are provided for maintaining the outer channels 12 in slave relation to the inner channel 11 since the inner channel is generally set to produce the thicker layer in the composite web. For this purpose, a suitable pressure transducer 29, which may be of the pneumatic type, is located to be responsive to the pressure in the central channel 11 upstream from the perforated partition plate 15, and similar pressure transducers 30 are located to be responsive to the upstream pressure in each of the outer channels 12. Each of the transducers 29 and 30 leads to a separate pressure transmitter 31 connected to individual pressure indicators 32 which may display on a suitable instrument panel (not shown) associated with the paper making machine. Each of the pressure transmitters 31 transmits a signal to an individual differential pressure transmitter 33. In the differential pressure transmitters 33 the signal from a pressure transmitter 34 connected with a pneumatic pressure transducer 35 in the slice end of the middle channel 11 is compared. The resulting differential signal from each of the differential pressure transmitters 33 is directed to an individual square root extractor 37 which extracts the square root of the various pressure differentials. This permits comparison of the stock velocity in the three channels of the distributor 5 since the pressure head and velocity of a liquid moving in a pipe, or enclosed channel, are related, such as by the formula $$h_f = f\frac{L}{4m}\ \frac{V^2}{2g} = CV^2$$

where $h$ = pressure head
$C$ = a constant
$f$ = pipe friction factor
$L$ = length of pipe or channel
$m$ = hydraulic radius
$g$ = gravitational acceleration
$V$ = velocity The signal from the square root extractor 37 for the center channel goes to a flow indicator 38 which may be located on the instrument panel. The signals from the two outer channels square root indicators 37 lead to respective flow indicating controllers 39 for each of the two outer channels 12.

Signal from the sqare root differential transmitter 37 for the center channel 11 is also fed into a separate ratio station 40 for each of the two outer channels 12 and which ratio stations are linked together. Due to their linked relationship, the ratio stations 40 generate identical setpoints 41 to the flow indicating controllers 39 based on the flow in the center channel 11. These setpoints 41 are then compared in the flow indicating controllers 39 for the two outer channels 12, with the signals from the outer channels square root pressure differential transmitters 37. Signals from the flow indicating controllers 39 are received by separate respective speed regulators 42 to control the respective drive motors 43 for the stock pumps 22. In this manner, the speed of the pumps 22 regulating the supply of stock for the two outer channels 12 is controlled as a function of the speed of the pump 17 supplying the center channel 11. If manual control of the stock velocity in either or both of the outer channels 12 is desired, the setpoints in respect to these channels can be set manually by respective auto/-man. switches 44 which may be located between the flow indicating controllers 39 and the speed regulators 42. Thereby complete control of the stock velocities in each of the outer channels 12 is provided for.

By virtue of the slave control of the outer channels 12 by the center channel 11, simply by controlling the velocity in the center channel 11 relative to the forming belt speed in the former of the machine provides for fully maintaining a desired rush/drag ratio (ratio of the wire speed to the velocity of the composition stream discharging from the distributor 5). This ratio is usually preferred at about 1.0, but might vary from about 1.1 to about 0.9, depending on such factors as machine speed, stock consistency and the type of paper (board) being made. The wire or belt speed is determined from the rotational speed of the associated couch roll (not shown) and is fed as indicated through a wire speed detector 45 into a rush/drag computer 47. During operation a pneumatic pressure transducer 48 in the downstream or slice end of the center channel 11 in the distributor 5 monitors the flow velocity and feeds signal to a differential pressure transmitter 49 which signals the rush/drag computer 47, in effect advising the differential pressure transmitter of the pressure of the composite stream of stock near the slice opening or orifice as measured by the transducer 48. Although the differential pressure transmitter 49 can operate independently, it is preferably linked with a pressure regulator 50 which biases the differential pressure transmitter 49 with air pressure which enables the transmitter 49 to send a signal with higher resolution to the rush/drag computer 47. This is desirable since the range of pressure within the distributor 5 during operation near the machine design speed at a desired stock consistency will not vary greatly, and not over the complete range of the transmitter 49. Therefore, higher resolution of the pressure indicated by the transmitter 49 is accomplished if it is controlled to read pressure over a narrower range spanning the actual pressures expected to be encountered during operation. To achieve this, the regulator 50 biases one side of the transmitter 49 with air pressure which is monitored by a manometer 51. This causes the transmitter 49 to operate over a lower range of, for example, 200 inches of water and thus increases its accuracy to, for example ¼% compared with, for example ½ to 1% which might be expected over a pressure range of 400 inches of water. By varying the biasing air pressure, the operating range and accuracy of the differential pressure transmitter 49 can be changed as desired.

In operation the rush/drag ratio computer 47 generates a setpoint 52 which is used by pressure indicting controller 53 to compare with the signal from the differential pressure transmitter 49 in order to send a corresponding signal to a speed regulator 54 for a motor 55 which drives the pump 17 for the center channel. Alternatively, the setpoint 52 may be set manually with an auto/man. switch 57.

From the foregoing it will be apparent that according to the present invention, not only is one of the stock channels of the distributor 5 in pilot control of any other channel in the distributor, but the distributor 5 is closely responsive to the speed of operation of the associated former of the paper machine. By having the outer layer stock delivery channels of the former 5 in automatic slave relation to the center channel 11, once the desired individual adjustments have been effected with respect to each of the channels and in the slice opening 7, accurate stock delivery and former speed ratio is automatically maintained during operation of the machine.

It will be understood that variations and modifications may be effected without departing from the spirit and scope of the novel concepts of this invention.

I claim as my invention:

1. A control system in a multi-channel paper machine distributor of the type having therein a plurality of channels to which fibrous paper stocks are respectively supplied from different respective sources through separate ducts supplying the paper stocks to upstreams ends of the channels, and a perforated partition within the distributor spaced from said upstream ends and through which the paper stocks pass from the channels into downstream portions of the channels which converge toward a slice opening which delivers the stocks from the plurality of channels in multi-ply relation to travelling forming means of a papermaking machine, and wherein there is a velocity differential between the stock flowing through the channels upstream from said partition in comparison with the stock flowing through said downstream portions of the channels comprising:

each of said ducts having a respective pump for driving the stock under controlled velocity into the channel into which the respective duct supplies stock, and each pump having a motor and a speed regulator for regulating the speed of the motor and thereby the velocity output of the pump;

each of said channels having a pressure transducer for monitoring the velocity of stock flowing through the respective channels upstream from said perforated partition;

a separate pressure transmitter connected to each of the pressure transducers;

a separate differential pressure transmitter connected to each of said pressure transmitters;

a pressure transducer monitoring the pressure in the downstream portion of one of said channels adjacent to said slice opening and connected to a pressure transmitter which transmits signals to all of the differential pressure transmitters for comparison in said differential pressure transmitters;

a separate square root extractor connected to each differential pressure transmitter to receive a differential signal therefrom, and the square root extractors functioning to extract the square roots of the various pressure differentials, for comparison of the stock velocities in said channels;

controlling means connected in controlling relation to the speed regulator of the motor of the pump which drives the stock in the duct supplying stock to at least one other of said channels;

and a ratio station connected to the square root extractor which is operatively connected to the pressure transducer monitoring the upstream portion of said one channel, said ratio station operating to generate a setpoint to said controlling means and thereby through the speed regulator connected thereto regulating the speed of the pump supplying stock to said another of said channels as a function of the speed of the pump supplying said one channel.

2. A system according to claim 1, wherein said distributor has three channels, said one channel being at the center of said three channels, said at least one other channel being the remaining two channels, and the ratio stations for both of said two remaining channels being linked.

3. A system according to claim 1, including means responsive to the speed of travel of the papermaking machine forming means for controlling the speed regulator of the pump of the supply duct for said one channel.

4. A system according to claim 3, wherein said forming means speed responsive controlling means comprise a rush-drag computer, and means coupled to the computer for monitoring velocity of stock flowing through said downstream portion of said one channel adjacent to the slice opening.

5. A system according to claim 4, including a differential pressure transmitter connected between said monitoring means and said rush-drag computer, and means coupled to this differential pressure transmitter for increasing the resolution of pressure indicated by this transmitter.

6. A system according to claim 1, including a separate stock supply duct communicating with the upstream side of each of said pumps, and means responsive to pressure in said supply ducts upstream from the pumps for controlling stock flow to the pumps.

7. A method of controlling multi-channel paper machine distributor of the type having therein a plurality of channels to which fibrous paper stocks are respectively supplied from different respective sources through separate ducts supplying the paper stocks to upstream ends of the channels and a perforated partition within the distributor spaced from said upstream ends and through which the paper stocks pass from the channels into downstream portions of the channels which converge toward a slice opening which delivers the stocks from the plurality of channels in multi-ply relation to travelling forming means of a papermaking machine and wherein there is a velocity differential between the stock flowing through the channels upstream from said partition in comparison with the stock flowing through said downstream portions of the channels, comprising:

operating a respective pump in each of said ducts and thereby driving the stocks under controlled velocity into the respective channels to be supplied with stock from the ducts;

operating a separate motor to drive each of the pumps;

monitoring through a pressure transducer in each of the channels upstream from said perforated partition the velocity of stock flowing through the respective channels;

transmitting stock flow velocity information from each of the transducers to a separate pressure transmitter and from each of the pressure transmitters to a separate differential pressure transmitter;

monitoring through a downstream pressure transducer the pressure in the downstream portion of one of said channels adjacent to said slice opening and from a pressure transmitter connected to the downstream pressure transducer transmitting signals to all of the pressure differential transmitters and therein comparing any differences in pressure in said downstream portion of said one channel with the pressures in said upstream portions of the channels;

extracting the square roots of the various pressure differentials and comparing the stock velocities in the channels;

generating a setpoint in accordance with the extracted square roots of the pressure differentions monitored in the upstream portion of said one channel;

and in response to said setpoint regulating the speed of the pump supplying stock to at least one other of said channels as a function of the speed of the pump supplying said one channel.

8. A method according to claim 7, wherein the distributor has three channels, said one channel being in the center of said three channels, said at least one channel being the remaining two channels.

9. A method according to claim 7, comprising controlling the speed of the pump of the supply duct for said one channel responsive to the speed of travel of the papermaking machine forming means.

10. A method according to claim 9, comprising controlling the speed of the pump of the supply duct for said one channel through a rush-drag computer, and monitoring velocity of stock flow through the downstream portion of said one channel adjacent to the slice opening through the computer.

11. A method according to claim 10, comprising increasing the resolution of pressure indicated by a pressure transmitter connected between said computer and a means for monitoring velocity of stock flowing through the downstream portion of said one channel adjacent to the slice opening.

12. A method according to claim 7, comprising controlling stock flow to each of the pumps in response to pressure in the supply ducts upstream from the pumps.

13. A control system in a multi-channel paper machine distributor of the type having therein a plurality of channels to which fibrous paper stocks are respectively supplied from different respective sources through separate ducts supplying the paper stocks to upstreams ends of the channels, and a perforated partition within the distributor spaced from said upstream ends and through which the paper stocks pass from upstream portions of the channels into downstream portions of the channels which converge toward a slice opening which delivers the stocks from the plurality of channels in multi-ply relation to travelling forming means of a papermaking machine, and wherein there is a velocity differential between the stock flowing through the channels upstream from said partition in comparison with the stock flowing through said downstream portions of the channels comprising:

each of said ducts having a respective pump for driving the stock under controlled velocity into the channel into which the respective duct supplies stock, and each pump having a motor and a speed regulator for regulating the speed of the motor and thereby the velocity output of the pump;

each of said channels having a pressure transducer for monitoring the velocity of stock flowing through its upstream portion;

a separate pressure transmitter connected to each of the pressure transducers;

a separate differential pressure transmitter connected to each of said pressure transmitters;

a pressure transducer monitoring the pressure in the downstream portion of one of said channels adjacent to said slice opening and connected to a pressure transmitter which transmits signals to all of the differential pressure transmitters for comparison in said differential pressure transmitters;

separate means receiving signals from each of said differential pressure transmitters for effecting comparison of the stock velocities in said channels;

controlling means connected in controlling relation to the speed regulator of the motor of the pump which drives the stock in the duct supplying stock to another of said channels;

and means connected to the means receiving signals which is operatively connected to the pressure transducer which monitors the upstream portion of said one channel to generate a setpoint to said controlling means and thereby through the speed regulator connected thereto regulating the speed of the pump supplying stock to said another of said channels as a function of the speed of the pump supplying said one channel.

14. A method of controlling multi-channel paper machine distributor of the type having therein a plurality of channels to which fibrous paper stocks are respectively supplied from different respective sources through separate ducts supplying the paper stocks to upstream ends of the channels and a perforated partition within the distributor spaced from said upstream ends and through which the paper stocks pass from upstream portions of the channels into downstream portions of the channels which converge toward a slice opening which delivers the stocks from the plurality of channels in multi-ply relation to travelling forming means of a papermaking machine and wherein there is a velocity differential between the stock flowing through the channels upstream from said partition in comparison with the stock flowing through said downstream portions of the channels, comprising:

operating a respective pump in each of said ducts and thereby driving the stocks under controlled velocity into the respective channels to be supplied with stock from the ducts;

operating a separate motor to drive each of the pumps;

monitoring through a pressure transducer in each of the channels upstream from said perforated partition the velocity of stock flowing through the respective channels;

transmitting stock flow velocity information from each of the transducers to a separate pressure transmitter and from each of the pressure transmitters to a separate differential pressure transmitter;

monitoring through a downstream pressure transducer the pressure in the downstream portion of one of said channels adjacent to said slice opening and from a pressure transmitter connected to the downstream pressure transducer transmitting signals to all of the pressure differential transmitters and therein comparing any differences in pressure in said downstream portion of said one channel with the pressures in said upstream portions of the channels;

generating a setpoint pursuant to information received from the pressure transducer monitoring the upstream portion of said one channel;

and in response to said setpoint regulating the speed of the pump supplying stock to said another of said channels as a function of the speed of the pump supplying said one channel.

* * * * *